US009109796B2

(12) United States Patent
Wark

(10) Patent No.: US 9,109,796 B2
(45) Date of Patent: Aug. 18, 2015

(54) TILT NOZZLE FOR COAL-FIRED BURNER

(76) Inventor: Rickey E. Wark, The Woodlands, TX (US)

( * ) Notice: Subject to any disclaimer, the term of this patent is extended or adjusted under 35 U.S.C. 154(b) by 1131 days.

(21) Appl. No.: 12/611,998

(22) Filed: Nov. 4, 2009

(65) Prior Publication Data

US 2010/0044457 A1 Feb. 25, 2010

Related U.S. Application Data

(63) Continuation of application No. 11/680,021, filed on Feb. 28, 2007, now abandoned.

(51) Int. Cl.
*F23D 1/02* (2006.01)
*F23D 1/00* (2006.01)

(52) U.S. Cl.
CPC .. *F23D 1/02* (2013.01); *F23D 1/00* (2013.01); *F23D 2201/101* (2013.01)

(58) Field of Classification Search
USPC ..... 110/261, 262, 263, 264, 265, 104 B, 110/104 R, 347; 165/59; 454/109, 152, 155; 239/587.6, 502, 503, 590, 590.5, 513, 239/518, 505
See application file for complete search history.

(56) References Cited

U.S. PATENT DOCUMENTS

| | | | | | |
|---|---|---|---|---|---|
| 2,363,875 | A * | 11/1944 | Kreisinger et al. | ..... | 110/263 |
| 4,377,107 | A * | 3/1983 | Izumi | ..... | 454/316 |
| 4,520,739 | A | 6/1985 | McCartney et al. | | |
| 5,195,450 | A * | 3/1993 | Marion | ..... | 110/347 |
| 5,215,259 | A * | 6/1993 | Wark | ..... | 110/263 |
| 7,624,707 | B2 * | 12/2009 | LaRue | ..... | 110/265 |

* cited by examiner

*Primary Examiner* — David J Laux
(74) *Attorney, Agent, or Firm* — Young Basile Hanlon & MacFarlane P.C.

(57) ABSTRACT

An improved end housing for nozzle assemblies used to project a stream of particulate coal into a burner housing. The improvement includes the addition of vertically-oriented, spaced parallel aiming plates. A four nozzle burner assembly has two sets of diagonally opposite nozzles in which all nozzles are aimed directly at the fireball center.

6 Claims, 5 Drawing Sheets

TILT NOZZLE FOR COAL-FIRED BURNER

CROSS-REFERENCE TO RELATED APPLICATION

This application is a continuation of the co-pending U.S. patent application Ser. No. 11/680,021 filed Feb. 28, 2007.

FIELD OF THE INVENTION

This invention relates to nozzles for coal-fired burners typically found in electrical utility plants and more particularly to a method and apparatus for re-aiming such nozzles.

BACKGROUND OF THE INVENTION

Coal-fired burners are commonly used to make steam in, for example, electrical generating plants. The burner structure includes a large enclosure with pre-aimed nozzles mounted at four diagonally-spaced locations. As schematically shown in FIG. 6A of the attached drawings, the nozzles direct streams of pulverized coal toward tangent points on an imaginary circle representing a fireball substantially at the center of the enclosure. Although the nozzles may include a capacity for tilting to raise or lower the fireball in the enclosure, there is no provision for adjusting lateral aim; therefore, the degree of tangentiality in the aiming of all four nozzles remains fixed after installation for all practical purposes.

SUMMARY OF THE INVENTION

I have found a practical and economical way to re-aim previously installed coal nozzles without incurring the expense and effort of major reconstruction such as tearing out the nozzles and modifying the boiler water wall openings. As a result of this discovery, burner-nozzle installations as schematically shown in FIG. 6A can be economically modified to re-aim the coal streams as shown in FIG. B wherein some or all of the coal streams are aimed directly at the center of the fireball; to achieve this, it is necessary to re-aim only two of the four nozzles by between about 5 and 7 degrees. The result I have found is a more circular fireball and reduced slag build-up and deterioration of the interior walls of the burner.

The objectives of my invention can be realized by mounting one or more vertically-oriented aiming plates on the horizontally-oriented splitter plates of existing nozzle end housings. The aiming plates can, for example, be pre-made as slotted plates which simply slide into the splitter plates, thereby eliminating the need to demount or replace existing components. Alternatively, the aiming plates can be installed in multiple pieces between the splitter plates. In either case, the aiming plates are typically hardfaced and welded into position.

My invention is usable with virtually all types of nozzles equipped with splitter plates including, by way of example, the replaceable insert nozzle disclosed in my U.S. Pat. No. 5,215,259 issued Jun. 1, 1993.

In another aspect, my invention is a method of re-aiming coal burner nozzles through the retrofit addition of vertically oriented aiming plates which are mounted on the pre-existing splitter plates in parallel spaced relation to one another and in orthogonal relationship to the splitter plates.

BRIEF DESCRIPTION OF THE DRAWING

FIGS. 6A and 6B are schematic diagrams of a typical burner housing with four nozzles wherein FIG. 6A shows the conventional aiming arrangement and FIG. 6B shows modified aiming according to my discovery.

DETAILED DESCRIPTION OF THE ILLUSTRATIVE EMBODIMENT

Figure 1:
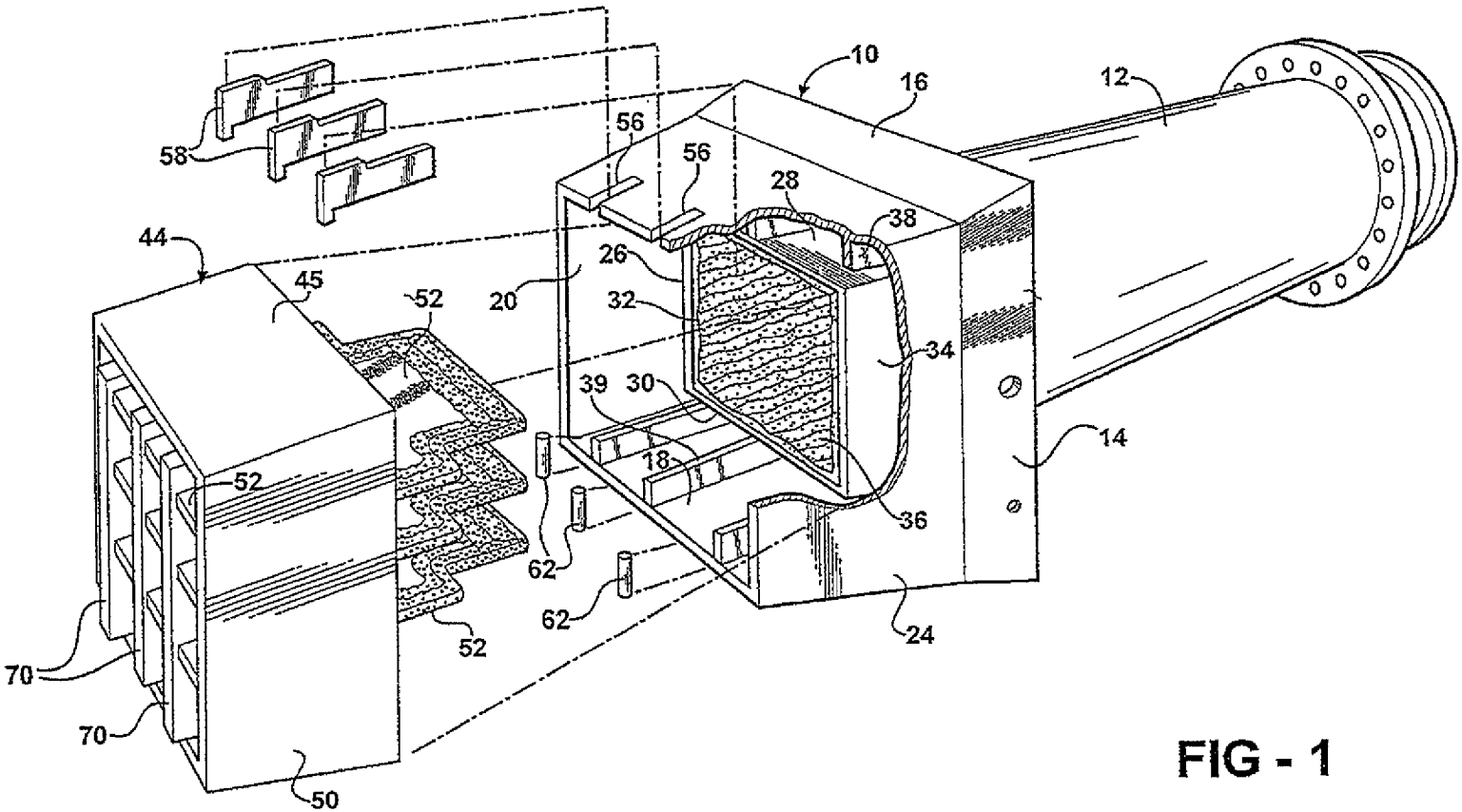
FIG. 1 is a perspective view of a burner nozzle assembly similar to that of my previous U.S. Pat. No. 5,215,259 with aiming plates added.
Figure 2:
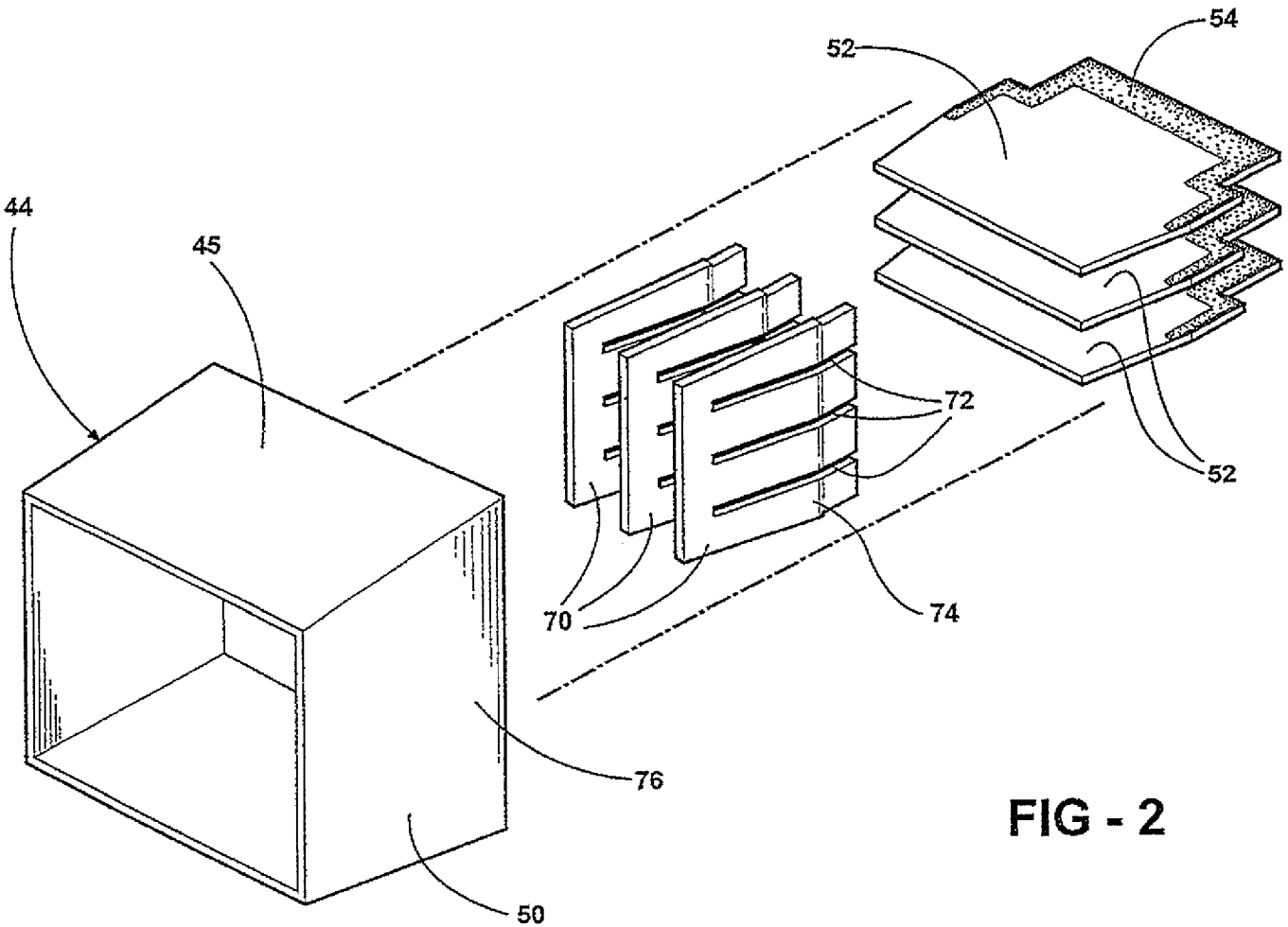
FIG. 2 is an exploded view of a burner end housing with splitter plates and aiming plates according to the invention.
Figure 3:
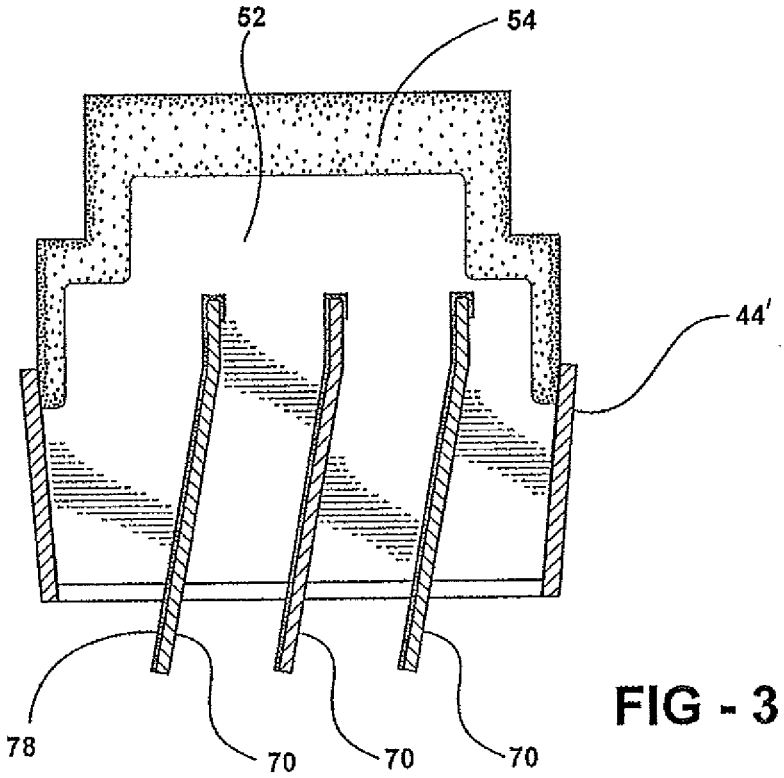
FIG. 3 is a top view in section of the nozzle end housing of FIG. 2.
Figure 4:
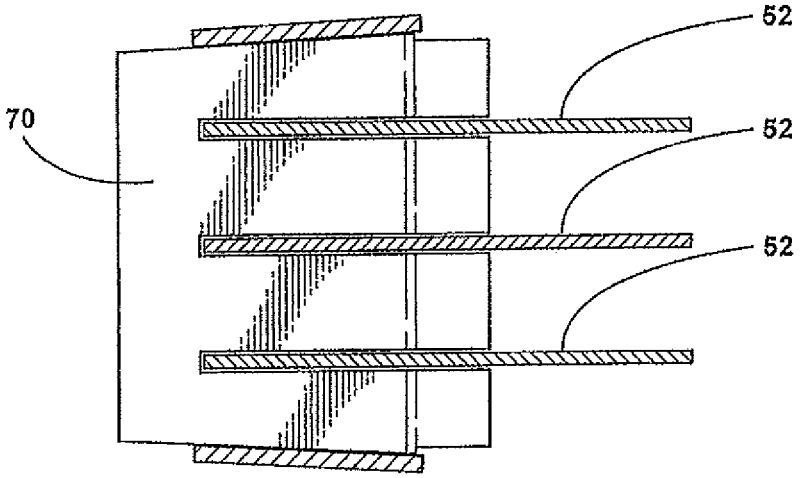
FIG. 4 is a side sectional view of the end housing structure of FIG. 2.

FIG. 1 illustrates my invention as applied to the replaceable nozzle assembly of my U.S. Pat. No. 5,215,259 showing the new aiming plates 70 and the following description will use essentially the reference characters and the vocabulary of the '259 patent in describing the structure of FIG. 1. It is to be understood that this is merely an illustrative application of my invention, and that it can be used to advantage with any nozzle having pre-installed horizontal splitter plates.

The particulate coal feed conduit is shown at 12 having a pivotal housing 14 with a top panel 16, a bottom panel 18 and side panels 20 and 24. The conduit 12 transitions from a round section to a square section having top and bottom panels 28 and 30 and side panels 32 and 34. The interior of the conduit 12 is hardfaced at 36 as shown. An end housing 44 is attached to the housing 14 and has tapering top and bottom panels 45, side panels 50 and a plurality of horizontally-oriented, vertically spaced splitter plates 52 fixedly installed between the side panels 50. The splitter plates are hard faced at the upstream edges as shown at 54

The nozzle assembly 10 of FIG. 1 is described in greater detail in the specification of my previously issued U.S. Pat. No. 5,215,259 the entire disclosure of which is incorporated herein by reference.

In accordance with my invention, I have added a plurality of the spaced parallel aiming plates 70 which can be seen at the exit side of the housing 44 to essentially laterally re-aim the nozzle assembly 10 relative to the center of a fireball which is fed with particulate coal carried by air streams using the nozzle assembly 10 and the newly structured end housing 44.

Turning now to FIGS. 2-5, only the modified end housing 44 will be described. As show in the figures, end housing 44 is essentially a rectangular box-like housing which tapers slightly from the entry end to the exit end. This is, of course, merely an illustrative configuration. The housing 44 has top, bottom and side walls 50 of welded steel and splitter plates 52 which are hard faced at 54 as shown. The splitter plates 52 are installed on the interior of the end housing 44 in essentially parallel and vertically spaced relationship to divide the particulate coal stream into four substreams as it enters the combustion chamber.

Figure 6A:
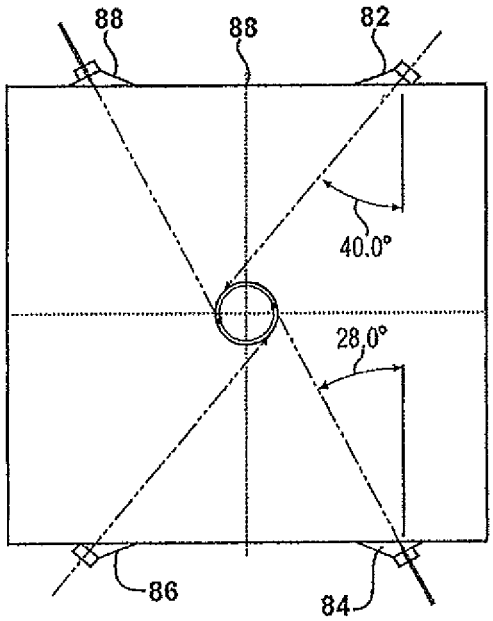
Figure 6B:
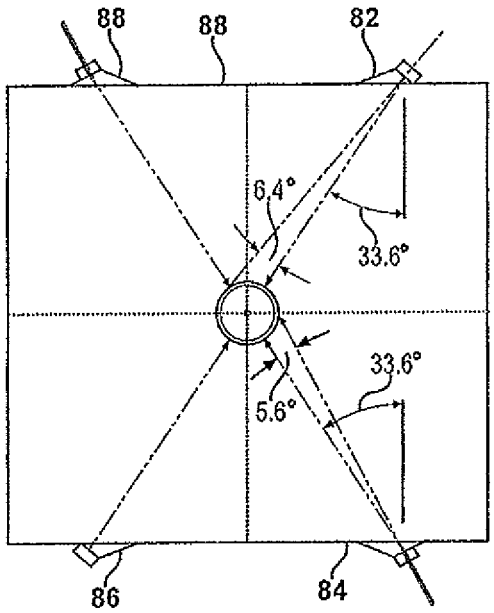

Retrofitted onto the splitter plates 52 are aiming plates 70 each fabricated to have three parallel mounting slots 72 and a bend point 74, the degree of bend being customized for each nozzle end housing 44 to laterally re-aim the end housing 44 relative to the center of a fireball and/or a burner chamber 88 as shown in FIG. 6B. The slots 72 allow the aiming plates 70 to slide onto the ends of the splitter plates 52 and be welded in place. Alternatively, each of the aiming plates can be installed in four pieces onto and between the splitter plates 52 if desired. Prefabrication of slotted plates makes for faster installation.

Figure 5:
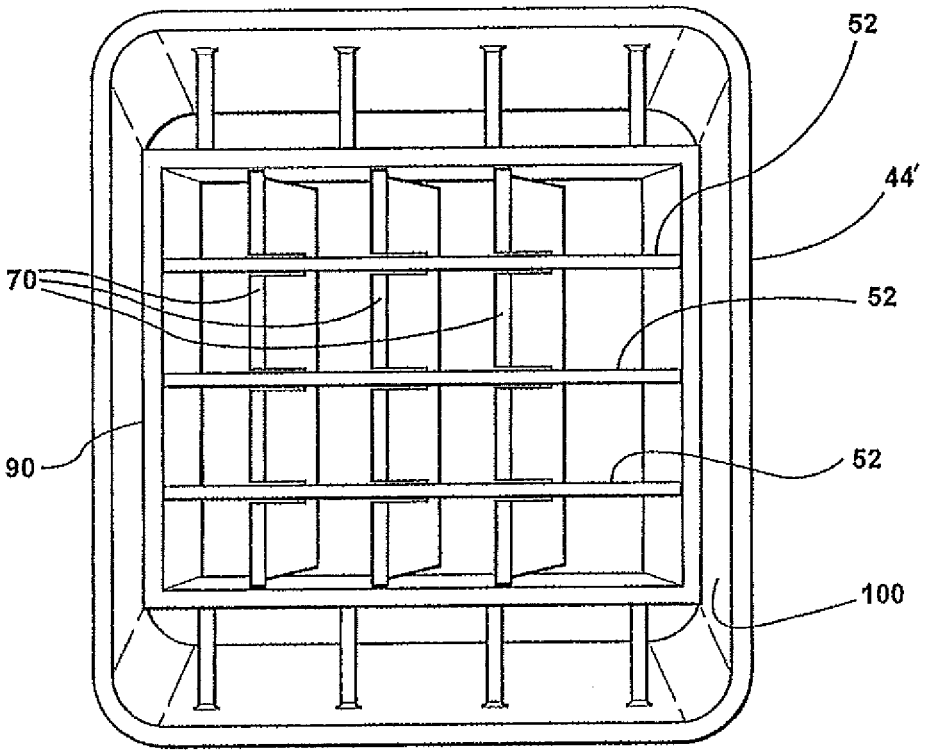
FIG. 5 is an interior view of an alternative nozzle structure using the invention.

FIG. 5 shows an alternative nozzle end housing 44' from the coal entry end. The nozzle housing 44' has an inner box 90 mounted within and spaced from the walls of the housing 44' for air flow. The splitter plates 52 are mounted between the sidewalls of the inner box 90 and, as was the case for the embodiment of FIGS. 2-4, the aiming plates 70 slide onto the splitter plates 52.

FIG. 6A shows a burner housing 88 with four nozzles 80, 82, 84 and 86 mounted on the outer wall thereof. The nozzles are conventionally and permanently aimed at tangent points to a fireball circle. FIG. 6B shows the burner housing after re-aiming nozzles 82 and 84 by 6.4° and 5.6° respectively such that all nozzles are aimed at the center of the fireball circle. These angles are given, of course, merely by way of example.

While the invention has been described with reference to an illustrative embodiment, it is to be understood that this description is merely illustrative and/or exemplary in nature and that various changes and additions may occur to persons skilled in the art in dealing with a particular nozzle and/or nozzle end housing.

What is claimed is:

1. A coal-fired burner nozzle housing of the type which can be mounted to direct an emergingly unignited stream of particulate coal in a predetermined direction and comprising an open entry side and an open exit side, and a plurality of horizontal splitter plates mounted in spaced parallel relationship within said housing to divide a stream of particulate coal flowing from the entry side to the exit side wherein the improvement comprises:

a plurality of aiming plates mounted on the splitter plates in parallel spaced relationship to one another and in substantially orthogonal relationship to said splitter plates said aiming plates being oriented so that the flow of particulate coal coming from said nozzle is at an angle to said aiming direction.

2. A burner nozzle component as described in claim 1 wherein the aiming plates are slotted to fit over the splitter plates.

3. A burner nozzle component as defined in claim 1 wherein said plates are bent such that at least part of each of the aiming plates is angled relative to a direct line between said entry and exit sides to deflect particulate coal in a pre-selected direction and to a pre-selected degree.

4. A burner nozzle component as defined in claim 1 wherein the splitter plates are at least partially hard faced.

5. A method of re-aiming a nozzle having a pre-fixed aiming direction for projecting a stream of emergingly unignited pulverized coal into a burner chamber where the stream is ignited to create a fireball comprising the step of:

mounting spaced-apart aiming plates on the splitter plates and orthogonally thereto to re-aim the coal stream away from the aiming pre-fixed direction.

6. A method of re-aiming a nozzle as defined in claim 5 wherein the aiming plates are slotted so as to slide onto and between the splitter plates.

* * * * *